US007145080B1

(12) United States Patent
Boisvert et al.

(10) Patent No.: US 7,145,080 B1
(45) Date of Patent: Dec. 5, 2006

(54) OFF-SET COMMUNICATIONS CABLE

(75) Inventors: Kevin Boisvert, Manchester, NH (US); Eugenio Urbina, Bow, NH (US); Brian Griggs, Goffstown, NH (US)

(73) Assignee: Hitachi Cable Manchester, Inc., Manchester, NH (US)

( * ) Notice: Subject to any disclaimer, the term of this patent is extended or adjusted under 35 U.S.C. 154(b) by 0 days.

(21) Appl. No.: 11/269,865

(22) Filed: Nov. 8, 2005
(Under 37 CFR 1.47)

(51) Int. Cl.
*H01B 7/00* (2006.01)

(52) U.S. Cl. ..... 174/110 R; 174/113 R; 174/113 C; 174/120 R; 174/120 SR

(58) Field of Classification Search ..... 174/36, 174/28, 110 R, 113 R, 120 R, 113 AS, 113 C, 174/120 SR, 120 SP
See application file for complete search history.

(56) References Cited

U.S. PATENT DOCUMENTS

| | | | | | |
|---|---|---|---|---|---|
| 2,123,209 | A | | 7/1938 | Rost | 173/265 |
| 2,212,927 | A | | 8/1940 | Baguley | 174/36 |
| 2,583,026 | A | * | 1/1952 | Swift | 174/117 R |
| 3,496,281 | A | | 2/1970 | McMahon | 174/29 |
| 3,595,275 | A | | 7/1971 | Steans et al. | 138/114 |
| 3,881,052 | A | | 4/1975 | Britz et al. | 174/103 |
| 4,528,420 | A | | 7/1985 | Kish et al. | 174/112 |
| 4,697,051 | A | | 9/1987 | Beggs et al. | 178/63 D |
| 4,952,020 | A | | 8/1990 | Huber | 350/96.23 |
| 5,132,488 | A | * | 7/1992 | Tessier et al. | 174/34 |
| 5,504,469 | A | * | 4/1996 | McGrane | 336/206 |
| 5,544,270 | A | | 8/1996 | Clark et al. | 385/101 |
| 5,569,876 | A | | 10/1996 | Podgorski | 174/28 |
| 5,574,250 | A | | 11/1996 | Hardie et al. | 174/36 |
| 5,659,152 | A | | 8/1997 | Horie et al. | 174/113 R |
| 5,789,711 | A | | 8/1998 | Gaeris et al. | 174/113 C |
| 5,952,615 | A | | 9/1999 | Prudhon | 174/113 C |
| 5,956,445 | A | | 9/1999 | Deitz, Sr. et al. | 385/100 |
| 5,969,295 | A | | 10/1999 | Boucino et al. | 174/113 C |
| 5,990,419 | A | * | 11/1999 | Bogese, II | 174/120 R |
| 6,150,612 | A | | 11/2000 | Grandy et al. | 174/113 C |
| 6,211,467 | B1 | | 4/2001 | Berelsman et al. | 174/113 R |
| 6,222,130 | B1 | | 4/2001 | Gareis et al. | 174/113 C |
| 6,225,563 | B1 | * | 5/2001 | Poulsen | 174/117 FF |
| 6,248,954 | B1 | | 6/2001 | Clark et al. | 174/113 R |
| 6,259,019 | B1 | | 7/2001 | Damilo et al. | 174/36 |
| 6,288,340 | B1 | | 9/2001 | Arnould | 174/113 R |
| 6,297,454 | B1 | | 10/2001 | Gareis | 174/113 C |
| 6,310,286 | B1 | | 10/2001 | Troxel et al. | 174/36 |
| 6,310,295 | B1 | | 10/2001 | Despard | 174/113 R |
| 6,355,876 | B1 | | 3/2002 | Morimoto | 174/27 |
| 6,365,836 | B1 | | 4/2002 | Blouin et al. | 174/113 C |

(Continued)

FOREIGN PATENT DOCUMENTS

| | | |
|---|---|---|
| DE | 3511085 | 10/1985 |

*Primary Examiner*—William H. Mayo, III
(74) *Attorney, Agent, or Firm*—Bowditch & Dewey, LLP

(57) ABSTRACT

A cable includes an outer sleeve for offsetting an inner jacket from a central axis of the outer sleeve in order to reduce crosstalk between adjacent cables. In one embodiment, an inner surface of the outer sleeve includes a plurality of fingers of different length extending inwardly to support the inner jacket offset from the central axis of the outer sleeve. The inner jacket may include two or more twisted pairs of electrical conductors and is supported in the offset position in order to randomize the location of the twisted pairs between cables when the cables are bundled together. In one embodiment, the cable also includes an inner divider core for further reducing crosstalk between adjacent twisted pairs within the cable.

16 Claims, 8 Drawing Sheets

U.S. PATENT DOCUMENTS

| | | | | |
|---|---|---|---|---|
| 6,448,500 | B1 | 9/2002 | Hosaka et al. | 174/113 R |
| 6,462,268 | B1 | 10/2002 | Hazy et al. | 174/36 |
| 6,492,588 | B1 | 12/2002 | Grandy | 174/36 |
| 6,506,976 | B1 | 1/2003 | Neveux, Jr. | 174/113 R |
| 6,566,605 | B1 | 5/2003 | Prudhon | 174/113 C |
| 6,570,095 | B1 | 5/2003 | Clark et al. | 174/113 R |
| 6,596,944 | B1 | 7/2003 | Clark et al. | 174/113 C |
| 6,800,811 | B1 | 10/2004 | Boucino | 174/113 C |
| 6,812,408 | B1 | 11/2004 | Clark et al. | 174/113 R |
| 6,818,832 | B1 | 11/2004 | Hopkinson et al. | 174/113 R |
| 6,855,889 | B1 | 2/2005 | Gareis | 174/113 C |
| 6,969,805 | B1 | 11/2005 | Lee et al. | 174/110 R |
| 6,974,913 | B1 | 12/2005 | Bahlmann et al. | 174/113 |
| 6,998,537 | B1 | 2/2006 | Clark et al. | 174/113 R |
| 7,009,105 | B1 | 3/2006 | Chou | 174/27 |
| 7,019,218 | B1 | 3/2006 | Somers et al. | 174/113 R |
| 2001/0001426 | A1 | 5/2001 | Gareis et al. | 174/113 C |
| 2001/0040044 | A1 | 11/2001 | Tabaddor et al. | 174/121 A |
| 2003/0106704 | A1 | 6/2003 | Isley et al. | 174/113 R |
| 2003/0205402 | A1 | 11/2003 | Koyasu et al. | 174/113 C |
| 2004/0055777 | A1* | 3/2004 | Wiekhorst et al. | 174/110 R |
| 2004/0055781 | A1 | 3/2004 | Cornibert et al. | 174/135 |
| 2004/0149483 | A1 | 8/2004 | Glew | 174/113 C |
| 2004/0026027 | A1 | 12/2004 | Kaczmarski | 174/113 R |
| 2005/0006132 | A1 | 1/2005 | William | 174/113 C |
| 2005/0029007 | A1 | 2/2005 | Nordin et al. | 174/113 R |
| 2005/0051355 | A1 | 3/2005 | Bricker et al. | 174/113 R |
| 2005/0092515 | A1 | 5/2005 | Kenny et al. | 174/113 R |
| 2005/0103518 | A1 | 5/2005 | Glew | 174/113 R |
| 2005/0092514 | A1 | 6/2005 | Kenny et al. | 174/113 R |
| 2005/0133246 | A1* | 6/2005 | Parke et al. | 174/113 R |
| 2005/0167149 | A1 | 8/2005 | Prescott | 174/113 C |

* cited by examiner

OFF-SET COMMUNICATIONS CABLE

TECHNICAL FIELD

The invention relates generally to high performance communications cables and, more specifically, to high performance communications cables having at least two twisted pairs of wires that are off-set from a central axis by an outer sleeve.

BACKGROUND

Electronic cables for use in applications such as telecommunication are well know and provide a highway through which much of today's digital information travels. Many of the cables which transmit digital information utilize pairs of wire twisted together, i.e. "twisted pairs", to form a balanced transmission line. One type of conventional cable for high-speed data communications includes multiple twisted pairs that are bundled and cabled together to form the high-speed cable.

Communications cable must generally achieve a high level of performance by adhering to industry standards for cable impedance, attenuation, skew and crosstalk isolation, among others. One such standard, IEEE (Institute of Electrical and Electronics Engineers) standard 802.3 for Ethernet applications, has been the key driver defining cable performance parameters and is the accepted standard for 10 gigabit per second operation.

In addition, standards exist which impose dimensional constraints and building code standards, for example fire performance safety requirements of the National Fire Protection Association (NFPA). Crosstalk is an important factor in evaluating cable performance in high tech environments as it represents signal energy loss or dissipation due to coupling between conductors or components of the cable. When twisted pairs are closely placed, electrical energy may be transferred from one pair of cable to another causing crosstalk. Such energy transfer, i.e. crosstalk, is undesirable because it causes interference to the information being transmitted through the twisted pair and can reduce the data transmission rate and can also cause an increase in the bit error rate.

Near end cross-talk (referred to as "NEXT") occurs between twisted pairs within the same cable, causing interfere with high frequency signal transmission. To control NEXT in unshielded twisted pair (UTP) cables, many cable designs utilize extremely short lay lengths and/or a central channel filler member that acts to physically separate the twisted pairs in order to improve crosstalk performance, as described in greater detail below. It is also known to individually shield the twisted pairs (ISTP) and electrically isolate them from one another by grounding the common shield plane, as also described below.

In a conventional cable, each twisted pair has a specified distance between twists along the longitudinal direction, which is referred to as the pair lay. The direction of the twist is known as the twist direction. When adjacent twisted pairs have the same pair lay and/or twist direction, they tend to lie within a cable more closely spaced than when they have different pair lays and/or twist direction. Such close spacing may increase the amount of undesirable crosstalk which occurs between adjacent pairs. In order to reduce crosstalk between twisted pairs some conventional cables utilize a unique pair lay in order to increase the spacing between twisted pairs within the cable. The twist direction may also be varied to reduce crosstalk.

Along with varying pair lays and twist directions, individual solid metal or woven metal pair shields are sometimes used to electromagnetically isolate pairs. Although they provide improved crosstalk isolation, shielded cables are more difficult and time consuming to install and terminate. Shielded conductors are generally terminated using special tools, devices and techniques adapted for the job which can be costly. Because of the concerns with shielded cables, a popular cable currently utilized is the unshielded twisted pair (UTP) cable. Because it does not include shielded conductors, UTP is preferred by installers and plant managers, as it may be easily installed and terminated. However, conventional UTP may fail to achieve superior crosstalk isolation, as required by state of the art transmission systems, even when varying pair lays are used.

Another method utilized to reduce crosstalk is the inclusion of a separator core, for example a "+" shape divider core as disclosed in U.S. Publication 2005/0006132. Each adjacent twisted pair is separated by the legs of the divider core in order to reduce and stabilize crosstalk between the adjacent twisted pairs. In order to reduce cost and the potential fire hazard caused by the material that forms the divider core, the profiles of the cores are minimized to decrease the amount of material used in the core.

Often multiple cables are bundled together into a hybrid cable in order to provide redundant networks and also for use with multiple hook ups. By bundling multiple cables within a single unit surrounded by an outer jacket the cost of installation is reduced to the consumer as many companies charge for installation by the foot. While the above described systems help reduce crosstalk within individual cables, when multiple cables are bundled together the separator core and varying pair lays and twist directions do not reduce cross talk in adjacent cables.

Crosstalk that occurs between adjacent, bundled cables is referred to as ANEXT. Attempts have been made in the field to reduce ANEXT in addition to NEXT. For example, some cables have been wrapped or include fillers in order to make the outer surface of the cables non-cylindrical in an attempt to reduce crosstalk between adjacent cables. However, since cable installers are accustomed to cables having a circular outer circumference, such cables can result in increased labor and cost to install.

While conventional methods have been found to be generally effective for reducing crosstalk within individual cables, there is continued development in the art to reduce crosstalk between cables when multiple cables are bundled together into a hybrid cable.

SUMMARY

In accordance with the present invention, there is provided a communications cable for reducing crosstalk between adjacent cables that are bundled together. In one embodiment, the cable to be bundled includes an outer sleeve for offsetting an inner jacket from a central axis of the outer sleeve. In one embodiment, an inner surface of the outer sleeve includes a plurality of fingers of different length extending inwardly to off-set the inner jacket from the central axis of the outer sleeve. The inner jacket may include two or more twisted pairs of electrical conductors and is supported in the offset position in order to randomize the location of the twisted pairs between cables when the cables are bundled together. In one embodiment, the cable also includes an inner divider core for further reducing crosstalk between adjacent twisted pairs within the cable.

BRIEF DESCRIPTION OF THE DRAWINGS

It should be understood that the drawings are provided for the purpose of illustration and explanation only and are not intended to define the limits of the invention. In the drawings, which are not intended to be drawn to scale, each identical or nearly identical component that is illustrated in various figures is represented by a like numeral. For purposes of clarity, not every component is labeled in every drawing. It is to be appreciated that this invention is not limited in its application to the details of construction and the arrangement of components set forth in description that follows, or illustrated in the drawings, in which.

Illustrative embodiments and aspects thereof will now be described in detail with reference to the accompanying figures.

DETAILED DESCRIPTION

Figure 1:
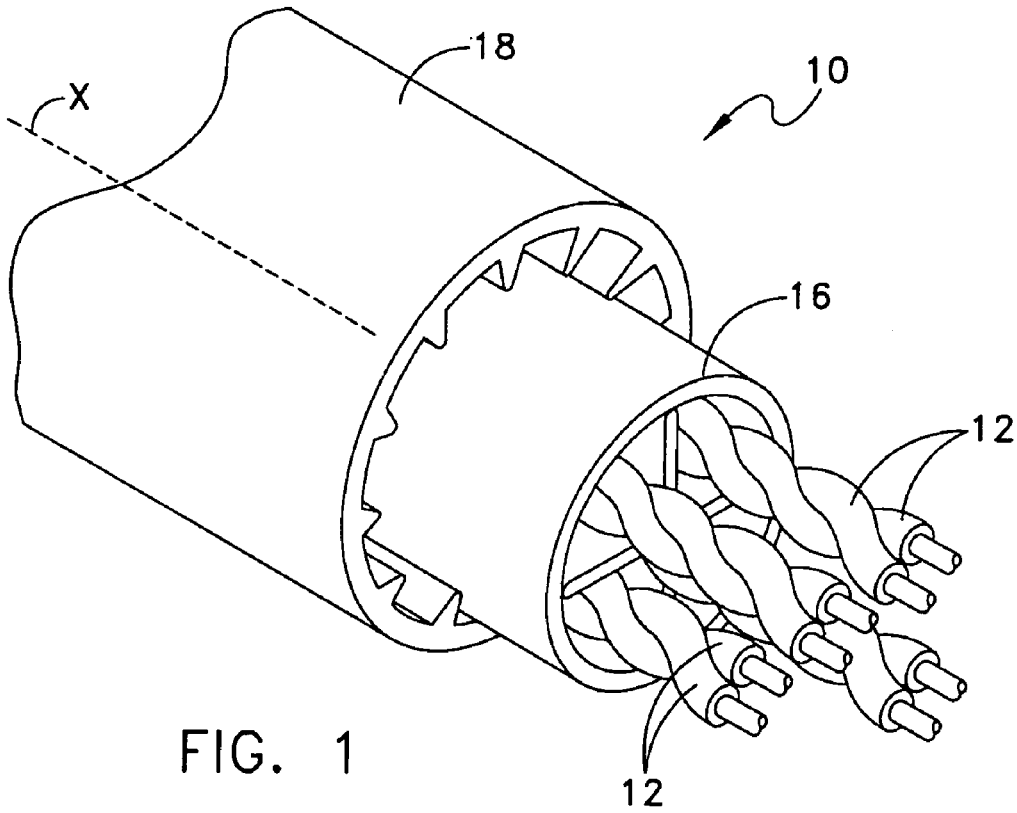
FIG. 1 is a perspective view of an offset communications cable according to one embodiment.
Figure 2:
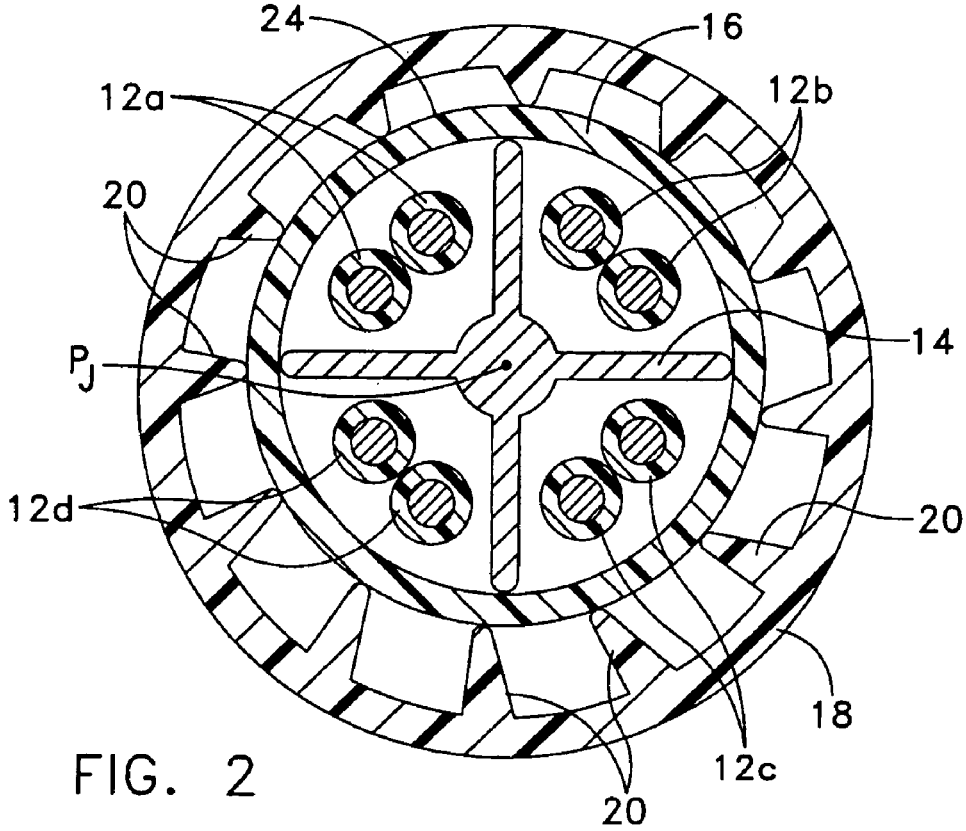
FIG. 2 is cross-sectional view of the offset cable of FIG. 1.
Figure 3:
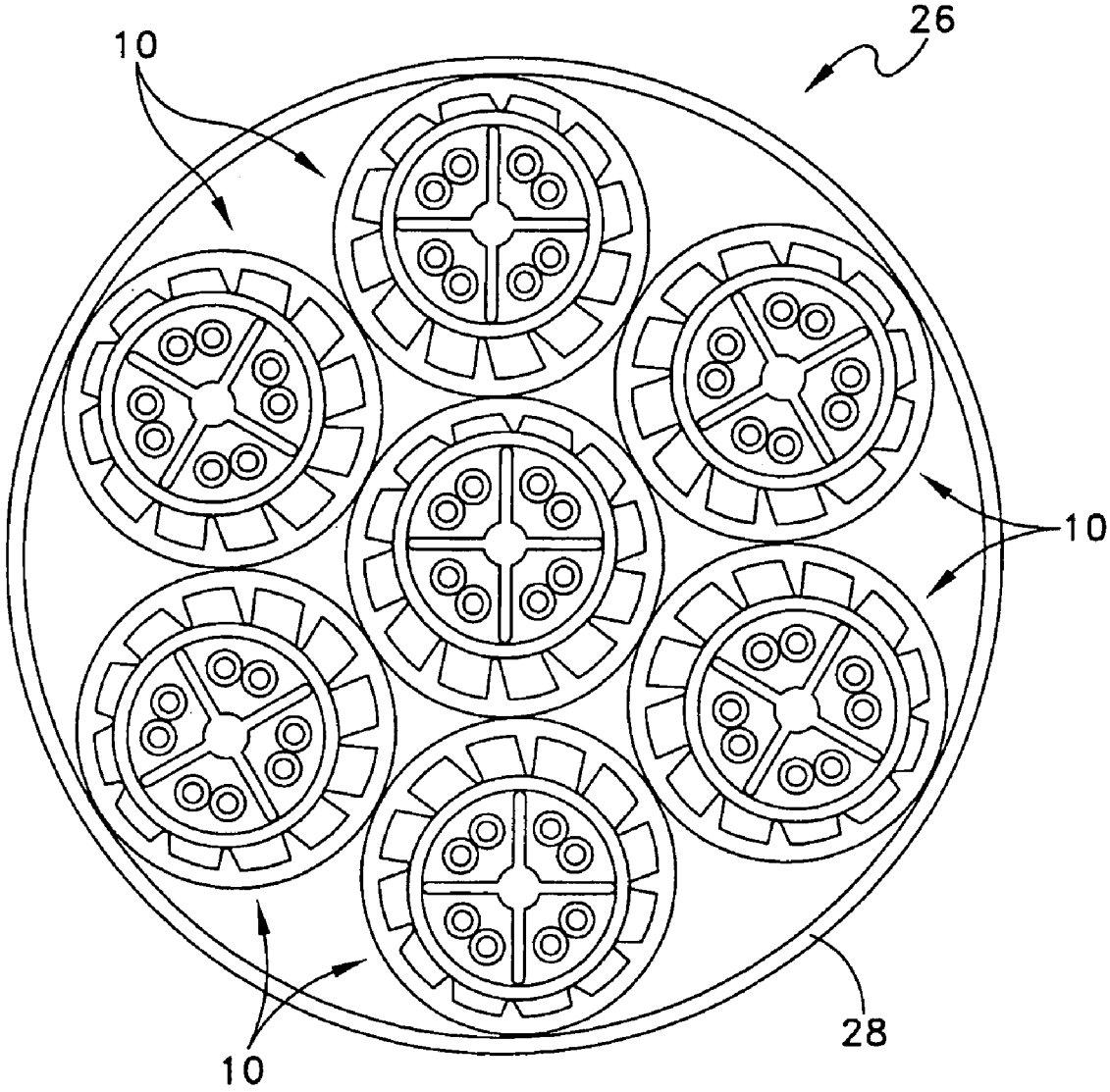
FIG. 3 is a front view of multiple offset communications cables of FIG. 1 bundled together.
Figure 4:
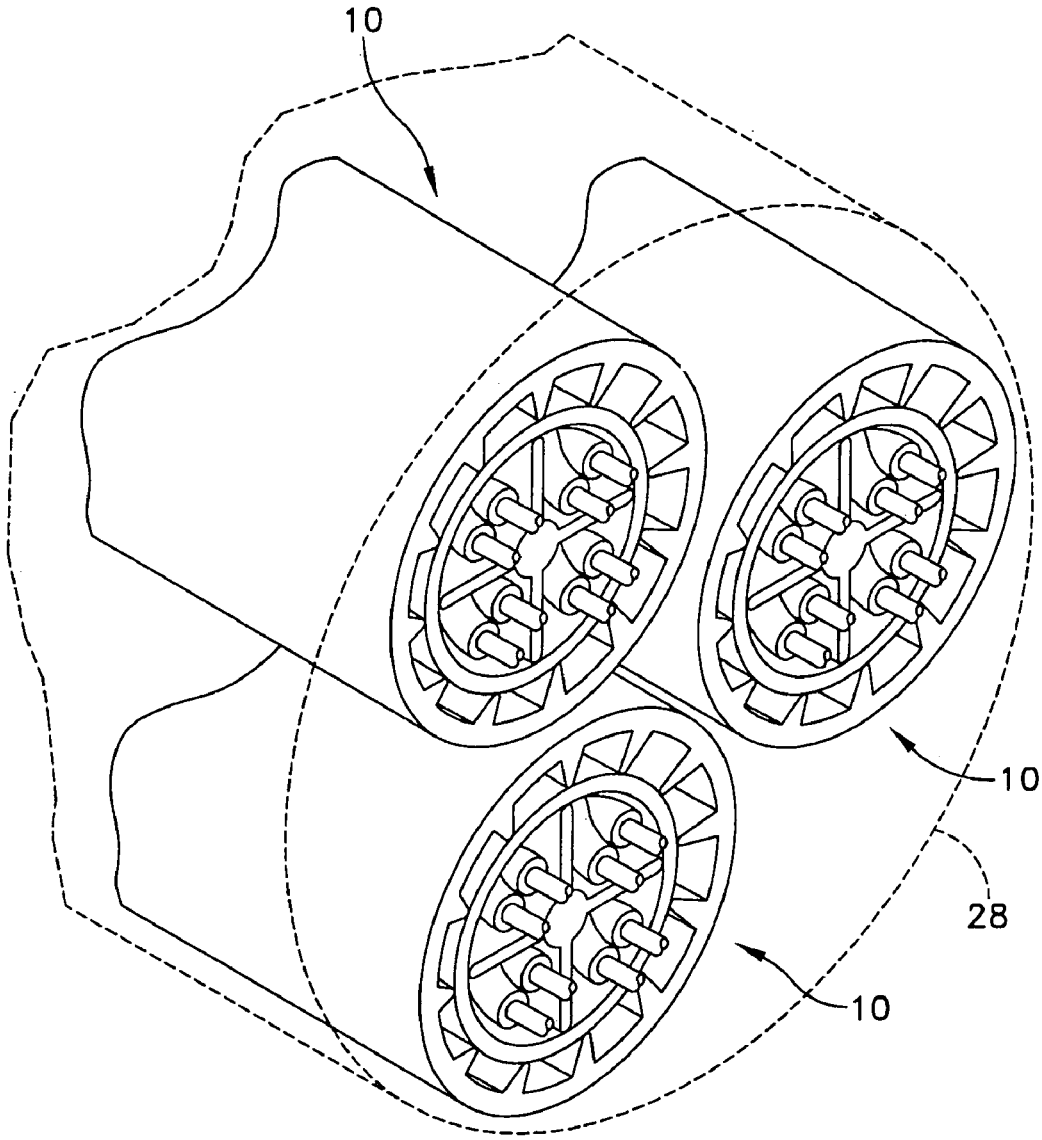
FIG. 4 is perspective view of the bundle of FIG. 3.

An offset communications cable 10 for reducing crosstalk is illustrated in FIGS. 1–2. The cable 10 includes an inner jacket 16 which is offset from a central axis, "x" of outer sleeve 18 in order to reduce crosstalk between adjacent cables that are bundled together into a hybrid cable as best shown in FIGS. 3–4. In the present embodiment, cable 10 is a 10 gig cable and may include four twisted pairs 12*a*, 12*b*, 12*c* and 12*d* of electrical conductors which are divided by an inner core 14. The twisted pairs are surrounded by the inner jacket 16 which has a tubular configuration, including a generally circular cross section. Although the following description will refer primarily to a 10 gig cable that is constructed to include four twisted pairs of insulated conductors and a core having a "+" shaped profile, it is to be appreciated that the invention is not limited to a 10 gig cable, the number of twisted pairs, or the core profile described in this embodiment. The inventive principles can be applied to alternate cables including greater or fewer numbers of twisted pairs and different core profiles. Also, although this embodiment of the invention is described and illustrated in connection with twisted pair data communication media, other high-speed data communication media can be used in constructions of cable according to disclosed embodiment and the core may also be eliminated, if desired. As used herein, the term "offset" refers to the inner jacket being non-concentric with respect to the outer sleeve, such that the center points of the inner jacket and outer sleeve are not aligned, i.e. are offset from each other.

Figure 5:
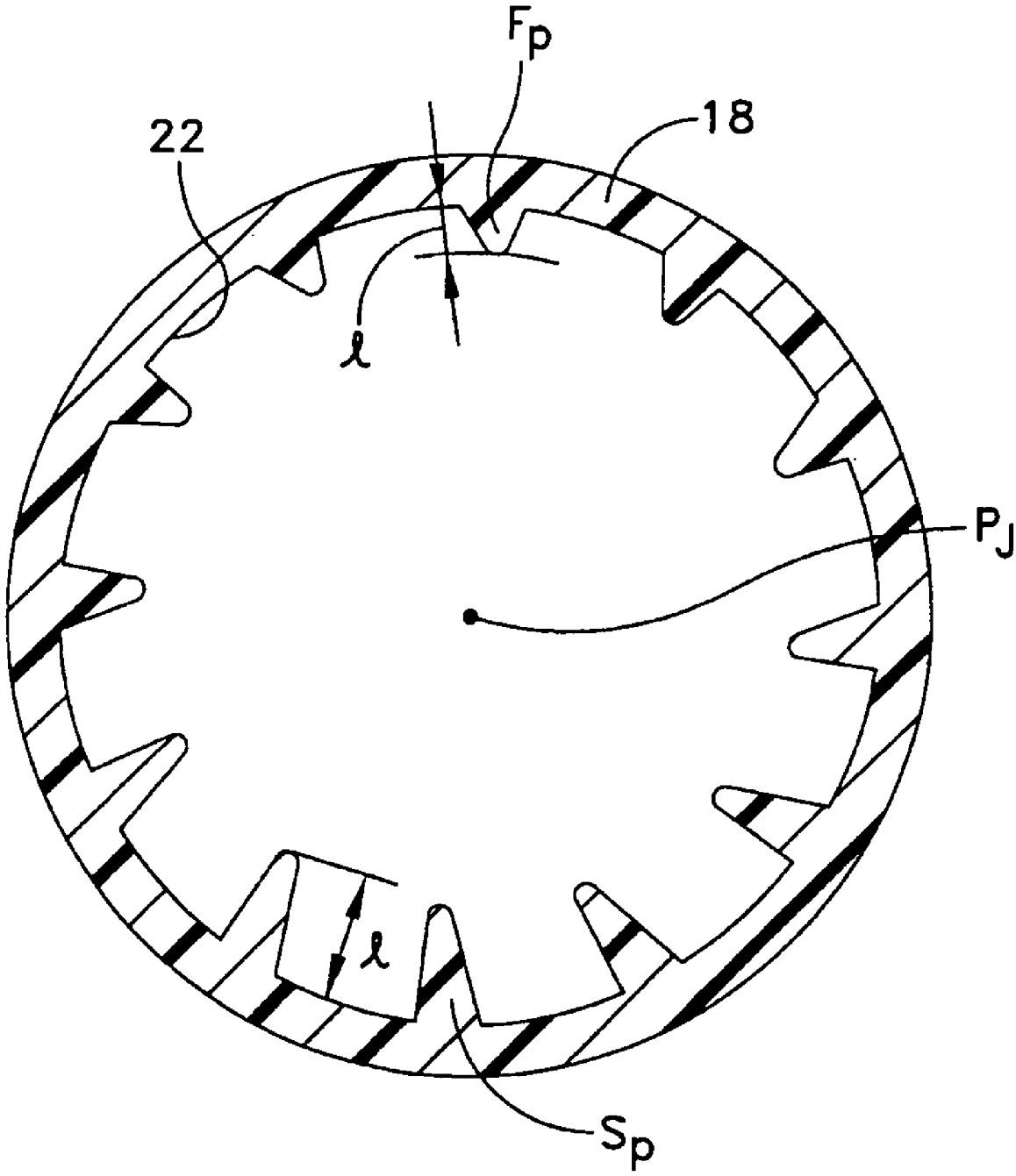
FIG. 5 is a cross-sectional view of an alternate embodiment of an outer sleeve for the offset communications cable of FIG. 1.
Figure 6:
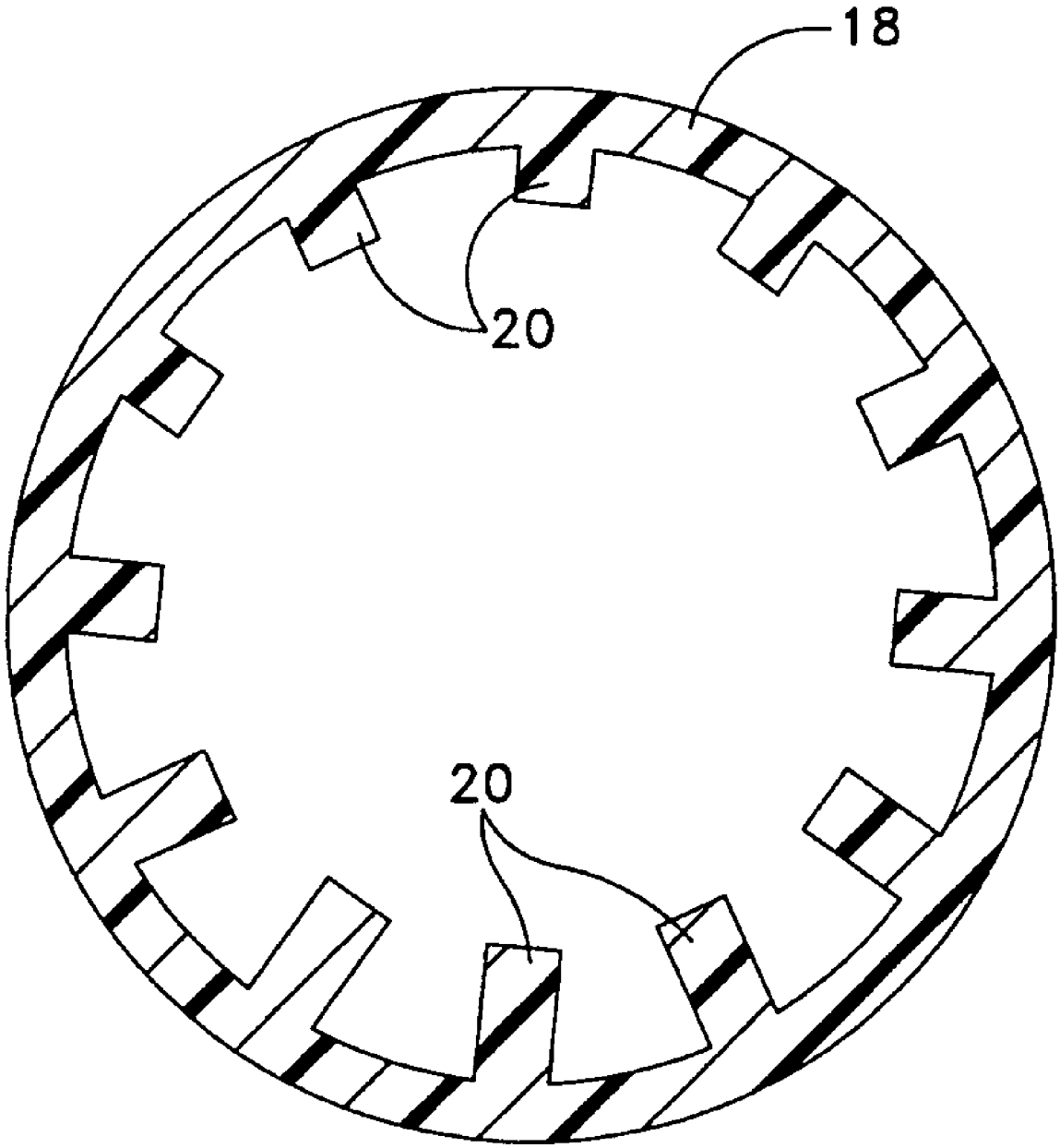
FIG. 6 is a cross-sectional view of another alternate embodiment of an outer sleeve for the offset communications cable of FIG. 1.
Figure 7:
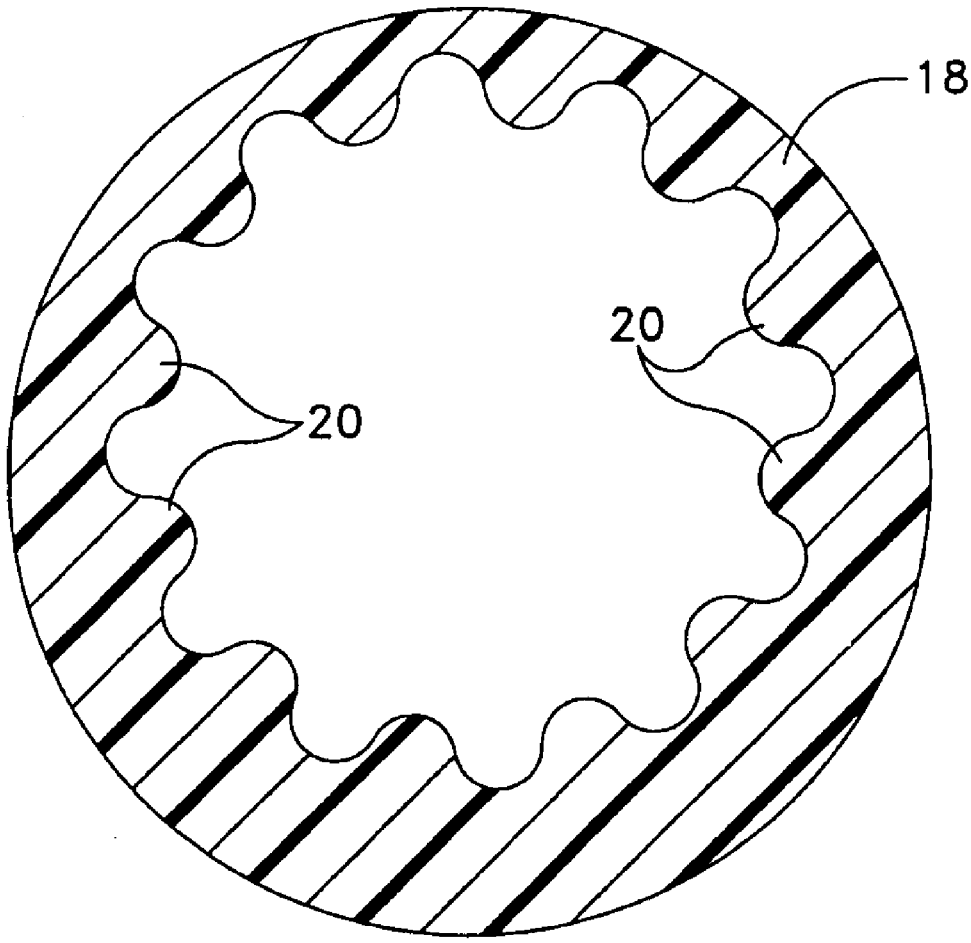
FIG. 7 is a cross-sectional view of another alternate embodiment of an outer sleeve for the offset communications cable of FIG. 1.

In the present embodiment, outer sleeve 18 includes a plurality of teeth 20 supported by and spaced along inner wall 22 of the sleeve 18. Each tooth 20 has a predefined length, "l", which extends between the inner wall 22 of the sleeve 18 and the outer wall 24 of inner jacket 16, when assembled. The predefined length of the teeth are preferably not uniform so as to vary from a first point $F_P$ to a second, opposite point $S_P$ along the inner wall 22, as best shown in FIG. 5. In the present embodiment, the individual teeth each gradually increases in length from point $F_P$ to point $S_P$. The teeth may also be grouped such that multiple adjacent teeth have the same length and the increase in length may be achieved between the groups of teeth instead of from individual tooth to individual tooth. As shown in FIGS. 1–5, the teeth may have a generally triangular shape. Alternatively, the teeth may have a variety of shapes, for example the teeth 20 may have a generally rectangular shape (FIG. 6), or the teeth 20 may be formed as a plurality of inwardly extending curved protrusions (FIG. 7). When assembled, the embodiments of FIGS. 6 and 7 operate in the same manner as that of FIG. 1 so as to support the inner jacket 16 offset from the outer sleeve 18 as described above.

By providing teeth having varying lengths, the outer sleeve supports the inner jacket in an offset manner such that the central axis "x" which extends through a center point $P_S$ (FIG. 5) of the outer sleeve does not extend through center point $P_J$ (FIG. 2) of the inner jacket. In the present embodiment the fingers 20 support the inner jacket 16 in this offset manner against external pressures which could otherwise move the inner jacket into a centered position within the outer sleeve, particularly when multiple cables are bundled together as illustrated in FIG. 3.

When multiple cables 10 are bundled together into hybrid cable 26 as shown in FIG. 3, the offset geometry of the individual cables randomizes the location of the twisted pairs 12 within adjacent cables. By randomizing the location of the twisted pairs of electrical conductors 12 that are housed within the individual cables, crosstalk between adjacent cables is reduced. In the present embodiment, the cables 10 are held together by an outer jacket 28, although the benefits of offsetting the inner sleeve and twisted pairs is achieved even if the multiple bundles are installed together without the outer jacket.

In the present embodiment, the outer sleeve 18 and outer jacket 16 each preferably has a substantially circular cross section which aids in installation of the cables as the outer geometry is uniform and substantially similar to conventional 10 gig cable geometries.

Figure 8:
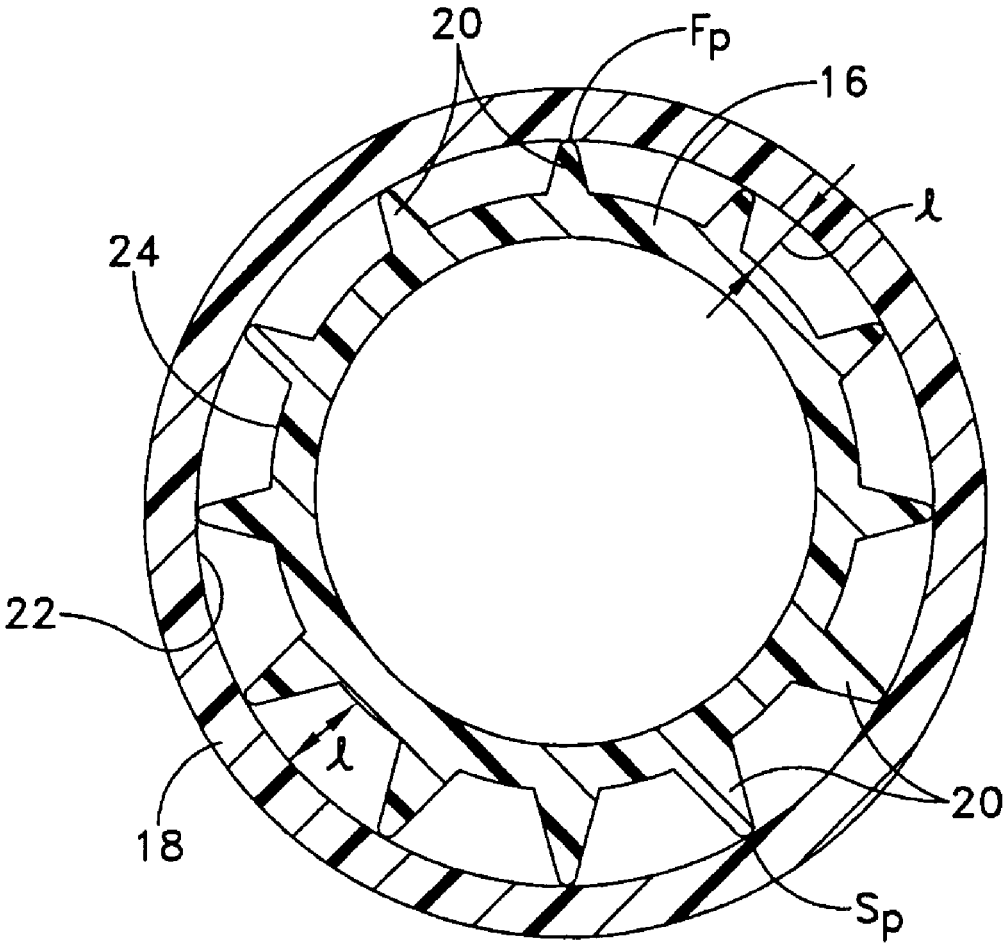
FIG. 8 is a cross-sectional view an offset communications cable according to a second embodiment.

Referring now to FIG. 8, an alternate embodiment is illustrated. In this embodiment, the plurality of teeth 20 are supported on an outer surface of the inner jacket 16. The plurality of teeth 20 thus extend outwardly from the outer wall 24 of the inner jacket 16 to the inner wall 22 of the outer sleeve 18. As described above, each tooth 20 has a predefined length, "l", which gradually increases from a first point $F_P$ to a second point $S_P$ along the outer wall 24. Alternatively, the teeth may also be grouped such that multiple adjacent teeth have the same length and the increase in length may be achieved between the groups of teeth instead of from individual tooth to individual tooth, as described above.

Figure 9:
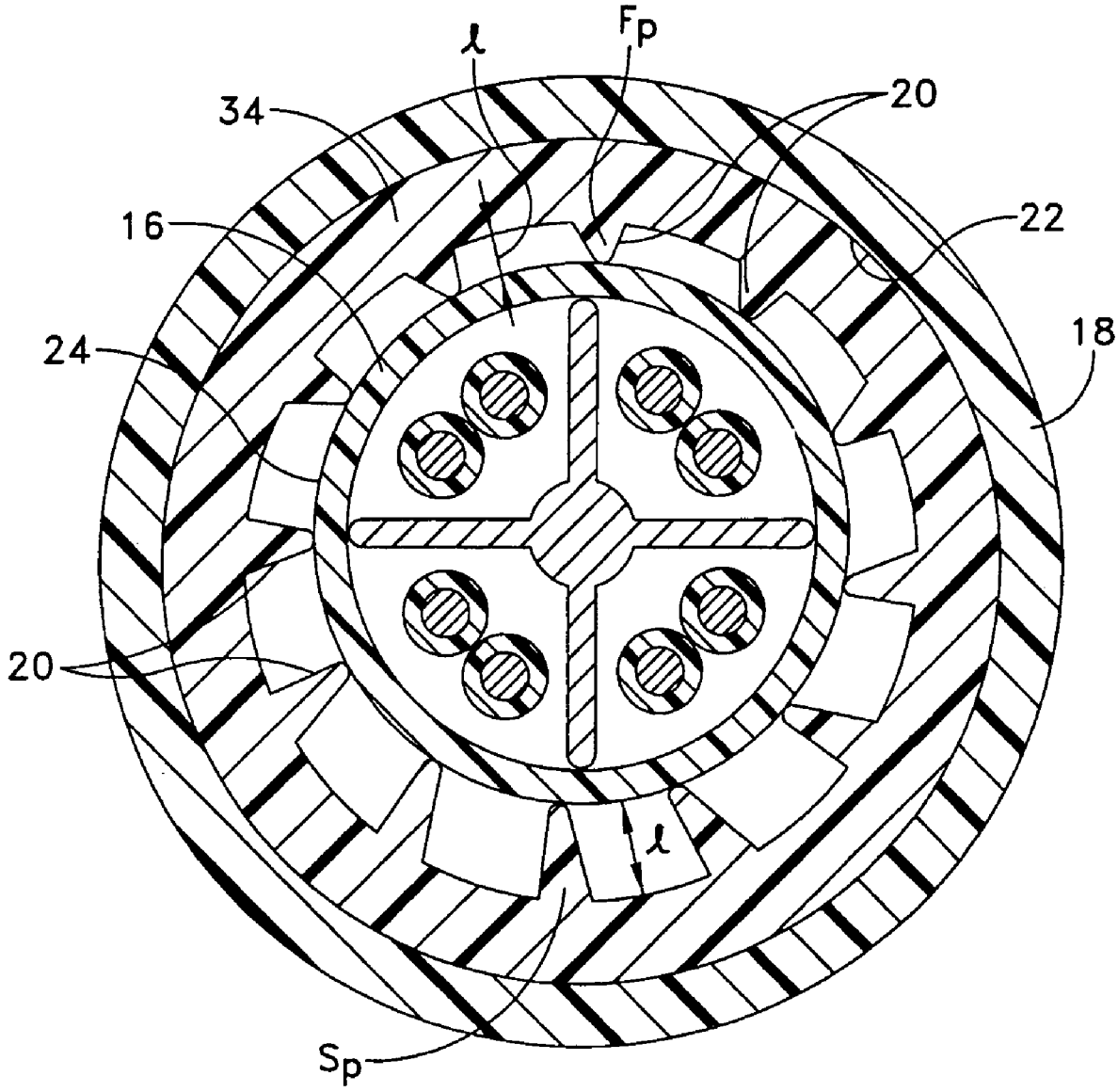
FIG. 9 is a cross-sectional view an offset communications cable according to a third embodiment.

Referring now to FIG. 9, another alternate embodiment is illustrated. In this embodiment, the plurality of teeth 20 are supported on a separate member 34 that is sandwiched between the inner wall 22 of the outer sleeve 18 and the outer wall 24 of the inner jacket 16. Again, each tooth 20 has a predefined length, "l", which gradually increases from a first point $F_P$ to a second point $S_P$ along the outer wall 24. Alternatively, the teeth may also be grouped such that multiple adjacent teeth have the same length and the increase in length may be achieved between the groups of teeth instead of from individual tooth to individual tooth.

As will be appreciated, all of the above described embodiments retain the center around which the conductors are positioned offset from the outer sleeve 18 in order to reduce crosstalk between cables once installed.

It will be understood that various modifications may be made to the embodiments disclosed herein. For example, although illustrated as being spaced from each other, the teeth may abut each other and may take other shapes other than those illustrated and described. In addition, the use of fewer or additional components as part of the cable is also contemplated, provided the inner conductors are support in an offset fashion as described above. Also, when used in a hybrid cable, not all of the cables need have an offset configuration. As many cables as needed may have the offset geometry in order to reduce crosstalk between adjacent cables. For example, if 3 cables are bundled together it may be sufficient that only one has an offset geometry, whereas the number may increase or all may have an offset geometry in other applications. Therefore, the above description should not be construed as limiting, but merely as exemplifications of a preferred embodiment. Those skilled in the art will envision other modifications within the scope, spirit and intent of the invention.

What is claimed is:

1. An offset cable for reducing crosstalk between adjacent cables, comprising:

an inner tubular jacket having a center point;

two or more pairs of conductors supported within the inner tubular jacket;

an outer sleeve including a center point, the outer sleeve being disposed about the inner tubular jacket;

a plurality of teeth supported between the inner tubular jacket and the outer sleeve, the plurality of teeth each having a length that extends between the inner tubular jacket and the outer sleeve, the length of the plurality of teeth being varied relative to each other; and wherein when assembled, the inner tubular jacket is held in an offset position relative to the outer sleeve by the plurality of teeth, such that the center point of the inner tubular jacket is not aligned with the center point of the outer sleeve.

2. The offset cable of claim 1, further comprising a core member constructed and arranged to physically separate the two or more pairs of conductors within the inner tubular jacket.

3. The offset cable of claim 1, wherein the plurality of teeth gradually increase in length from a first point adjacent the outer sleeve to a second point opposite the first point.

4. The offset cable of claim 1, wherein the plurality of teeth have a shape selected from the group consisting of a generally triangular shape, generally rectangular shape and a generally rounded shape.

5. The offset cable of claim 1, wherein the plurality of teeth are supported on an inner wall of the outer sleeve.

6. The offset cable of claim 1, wherein the plurality of teeth are supported on an outer wall of the inner jacket.

7. The offset cable of claim 1, wherein the plurality of teeth are supported on an annular member disposed between the outer sleeve and the inner jacket.

8. The offset cable of claim 1, wherein the two or more pairs of conductors comprise two or more twisted pairs.

9. The offset cable of claim 1, in combination with at least one other offset cable, wherein the offset cables are bundled together into a hybrid cable.

10. The offset cable of claim 1, wherein the plurality of teeth extend substantially around the entire inner surface of the cable.

11. A hybrid cable assembly having reduced crosstalk, comprising:

an outer jacket;

two or more internal cables disposed within the outer jacket, each of the two or more cables comprising:

a) an inner tubular jacket having a center point;

b) two or more twisted pairs of conductors supported within the inner tubular jacket;

c) an outer sleeve including a center point, the outer sleeve being disposed about the inner tubular jacket;

d) a plurality of teeth supported between the inner tubular jacket and the outer sleeve, the plurality of teeth each having a length that extends between the inner tubular jacket and the outer sleeve, the length of the plurality of teeth increasing from a first point adjacent the outer sleeve to a second point opposite the first point so as to hold the inner tubular jacket in an offset position relative to the outer sleeve, such that the center point of the inner tubular jacket is not aligned with the center point of the outer sleeve; and wherein the distribution of the two or more cables is randomized within the outer jacket by the offsetting of the inner jacket relative to the outer sleeve so as to reduce cross talk between the two or more cables.

12. The hybrid cable assembly of claim 11, wherein the plurality of teeth have a shape selected from the group consisting of a generally triangular shape, generally rectangular shape and a generally rounded shape.

13. The hybrid cable assembly of claim 11, wherein the plurality of teeth are supported on an inner wall of the outer sleeve.

14. The hybrid cable assembly of claim 11, wherein the plurality of teeth are supported on an outer wall of the inner jacket.

15. The hybrid cable assembly of claim 11, wherein the plurality of teeth are supported on an annular member disposed between the outer sleeve and the inner jacket.

16. The hybrid cable assembly of claim 11, further comprising an inner core constructed and arranged to physically separate the two or more twisted pairs of conductors within the inner tubular jacket.

* * * * *